US006584752B1

(12) United States Patent
Herava

(10) Patent No.: US 6,584,752 B1
(45) Date of Patent: Jul. 1, 2003

(54) WRAPPING METHOD AND WRAPPING APPARATUS

(75) Inventor: Ismo Herava, Naantali (FI)

(73) Assignee: United Packaging PLC, West Yorkshire (GB)

( * ) Notice: Subject to any disclaimer, the term of this patent is extended or adjusted under 35 U.S.C. 154(b) by 0 days.

(21) Appl. No.: 09/959,620

(22) PCT Filed: May 4, 2000

(86) PCT No.: PCT/FI00/00399

§ 371 (c)(1),
(2), (4) Date: Nov. 1, 2001

(87) PCT Pub. No.: WO00/66434

PCT Pub. Date: Nov. 9, 2000

(30) Foreign Application Priority Data

May 4, 1999 (FI) ..... 991020

(51) Int. Cl.[7] ..... B65B 13/16

(52) U.S. Cl. ..... 53/399; 53/441; 53/556; 53/587; 53/588

(58) Field of Search ..... 53/587, 588, 399, 53/540, 441, 556, 307

(56) References Cited

U.S. PATENT DOCUMENTS 4,936,080 A 6/1990 Haloila ..... 53/465
5,048,261 A 9/1991 Lancaster, III et al. ..... 53/399
5,195,301 A * 3/1993 Martin-Cocher et al. ..... 53/441
5,450,711 A * 9/1995 Martin-Cocher ..... 53/556
5,463,842 A * 11/1995 Lancaster ..... 53/399
5,819,503 A 10/1998 Lancaster, III ..... 53/399

FOREIGN PATENT DOCUMENTS

FI 80418 B 11/1990

* cited by examiner

*Primary Examiner*—Rinaldi I. Rada
*Assistant Examiner*—Gloria R Weeks
(74) *Attorney, Agent, or Firm*—Kubovcik & Kubovcik

(57) ABSTRACT

A method of packaging by wrapping and a wrapping machine (20), in which method a top film (64) is cut into a top film sheet (65) and pulled on top of a top film carrier (54) turned upside down, to a position above the object being packaged (31). After this the carrier and the top film held in place by means of suction nozzles (55) are turned around and pressed with the help of the pressing device (53) onto the object being packaged. During the first stage of wrapping, the edges of the top film sheet are held up by means of the suction nozzles of the carrier and plastic film web is wrapped around the article being packaged from bottom to top. After this, the edges of the top film sheet are pressed down by means of blow nozzles, and plastic film web is also wrapped on top of the edges of the plastic film sheet.

9 Claims, 10 Drawing Sheets

WRAPPING METHOD AND WRAPPING APPARATUS

Figure 1:
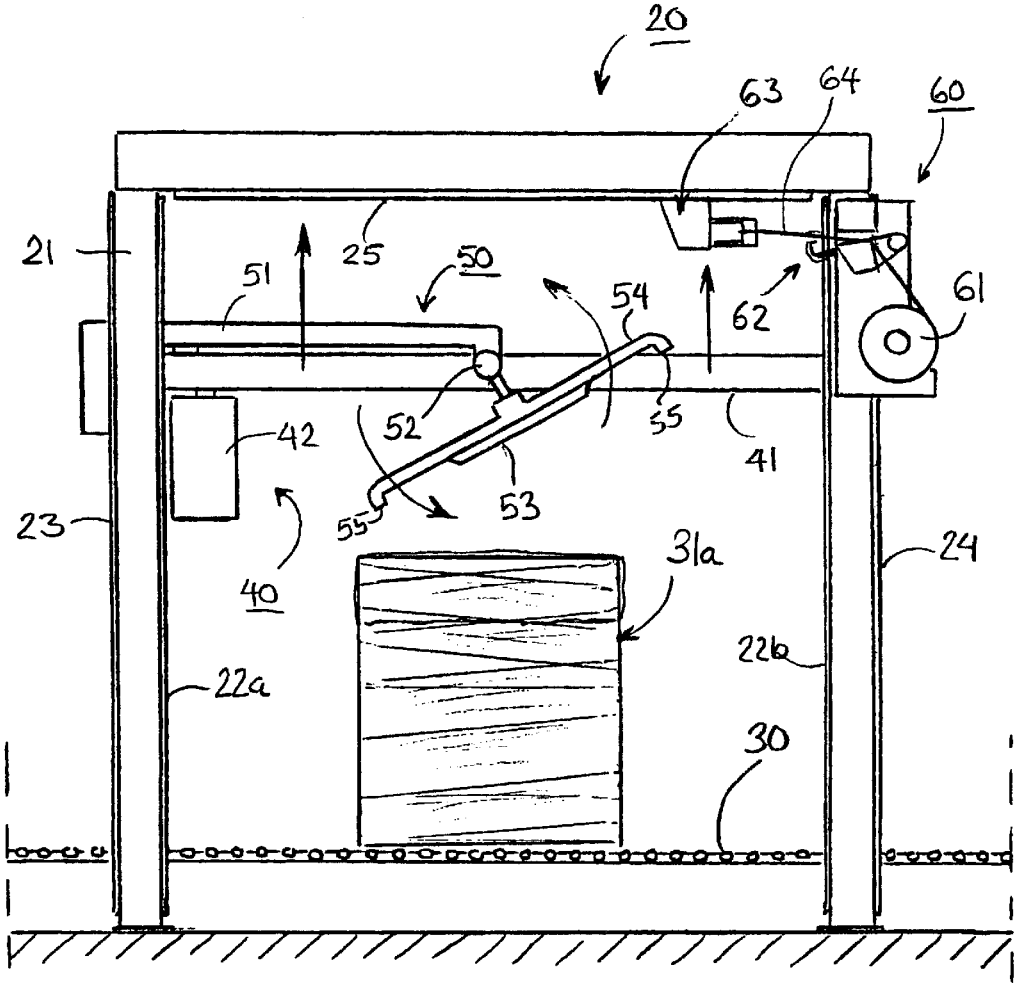

The invention relates to a method of packaging by wrapping, according to which method a top film is placed on top of an object being packaged and plastic film web used as packaging material is wrapped around the object being packaged, and which method involves the following stages:

- a top film sheet of the desired size is cut from the top film web, which sheet is brought to the wrapping station to a position above the object being packaged,
- during the first wrapping stage, plastic film web is wrapped around the object being packaged, preferably from bottom to top,
- the edges of the top film sheet are turned downwards on top of the already wrapped plastic film layer,
- and during the second wrapping stage, plastic film web is wrapped on top of the edges of the top film sheet.

The invention also relates to a wrapping machine for packaging the object being packaged with the top film and the plastic film web used for wrapping, the wrapping machine comprising:

- a cutting device for cutting a top film sheet of the desired size from the top film web,
- a device for bringing the top film sheet to the wrapping station, to a position above the object being packaged,
- a wrapping device for wrapping the plastic film web around the object being packaged,
- and a device for turning the edges of the top film sheet downwards onto the sides of the object being packaged.

According to a known method of wrapping waterproof packages, a top film is brought on top of the object being packaged from a roll of plastic film in two stages, so that the edge of the plastic film is first pulled to the centre of the object being packaged, from where the end of the plastic film is fetched and pulled across the wrapping station and cut to a fixed size while wrapping is interrupted, during the changeover of the products being packaged. The edges of the top film are then gripped and it is kept spread open above the object being packaged. When the first film layer has been wrapped, wrapping is interrupted for a short period during which the grip on the top film sheet is released and the edges of the top film are turned against the side surfaces of the object being packaged by means of air jets.

In a known wrapping machine, there is a top film feeding device and a drawing device, which move simultaneously in opposite directions. When wrapping is interrupted during the changeover of the products being packaged, the drawing device first pulls the edge of the top film to the centre of the object being packaged, from where the end of the top film is fetched and drawn across the wrapping station. The cutter cuts the top film to a fixed size. The wrapping machine comprises mechanical holders, which grip the edges of the top film and keep it spread open above the object being packaged. When the first plastic film layer has been wrapped, wrapping is interrupted for a short period and air jets turn the edges of the top film against the side surfaces of the object being packaged.

The wrapping machine described above, which relates to a known method of packaging by wrapping, is faster than earlier wrapping machines, but wrapping still has to be interrupted after the first film layer has been wrapped, when the top film sheet is released and its edges are turned against the side surfaces of the object being packaged.

The aim of the present invention is to provide a waterproof package according to a new method, which is more efficient than known methods. According to the method of packaging by wrapping, the wrapping of the object being packaged in the wrapping machine does not have to be interrupted in between. The wrapping at most slows down somewhat. Thus, a package provided with a top film can be made within almost the same time as an article without a top film is packaged. The capacity of the wrapping machine relating to the invention is in fact almost the same, regardless of whether a top film is used in the package or not.

By means of the invention, the top film is brought to the wrapping machine at a moment when wrapping is in any case interrupted, that is, when the packaged article is being removed from the wrapping station and the next object to be packaged is being brought to the wrapping station. It is also an essential feature that the forward movement of the objects being packaged and the already packaged articles on the conveyor track does not need to be interrupted or substantially slowed down.

The method of packaging by wrapping relating to the invention is characterised in

- that the top film sheet brought to the wrapping station, to a position above the object being packaged, is turned upside down and placed on top of the object being packaged,
- that during the first wrapping stage, the edges of the top film sheet are kept lifted up, after which the edges of the top film sheet are turned downwards and the second wrapping stage is carried out.

According to a preferred embodiment of the method relating to the invention

- the top film is brought to the wrapping station, to a position above the object to be packaged, even before the object being packaged is changed over at the wrapping station,
- and that during the changeover of the objects being packaged, the top film sheet is cut and fetched by turning it upside down and placing it on top of the object being packaged.

According to a second preferred embodiment of the method relating to the invention, the top film sheet is pressed onto the object being packaged by means of a pressing device while at the same time lifting the edges of the top film sheet upwards by means of the suction nozzles of the top film sheet carrier.

According to a third preferred embodiment of the method relating to the invention, the top film sheet is gripped by means of suction nozzles and the edges of the top film sheet are pressed downwards by means of blow nozzles.

According to a fourth preferred embodiment of the method relating to the invention, the same nozzle is used as a suction nozzle and a blow nozzle, the function of which nozzle is selected by connecting the nozzle duct either to the suction side of the fan or the pressure side of the fan.

The wrapping machine relating to the invention is characterised in

- that the wrapping machine comprises a top film carrier for receiving the top film sheet on top of it,
- that the top film carrier comprises a means for keeping the top film sheet attached to the top film carrier,
- and that the top film carrier comprises a means for turning it upside down and for carrying the top film sheet under the top film sheet carrier and further on top of the article being packaged.

According to a preferred embodiment of the wrapping machine relating to the invention, the gripping means of the top film sheet carrier are suction nozzles and the pushing means are blow nozzles.

According to a second preferred embodiment of the wrapping machine relating to the invention the nozzles of the top film sheet carrier are double acting, so that the same nozzles serve as both suction nozzles and blow nozzles, the nozzles are connected to the fan by means of a change-over valve in such a way that the nozzles are suction nozzles when the change-over valve connects the nozzles to the suction side of the fan, and the nozzles are blow nozzles when the change-over valve connects the nozzles to the pressure side of the fan.

According to a third preferred embodiment of the packaging machine relating to the invention, a pressing device is attached to the top film carrier of the wrapping machine for pressing the top film sheet onto the article being packaged.

According to a fourth preferred embodiment of the packaging machine relating to the invention, the top film carrier and pressing device of the wrapping machine are located above the rotation ring in such a way that the combined top film carrier and pressing device can be lifted by means of the rotation ring.

The invention is described in greater detail in the following, with reference to the appended drawings, in which FIG. 1 shows the wrapping machine relating to the invention as seen from the side.

FIGS. 2–9 correspond to FIG. 1 and show different stages in the operation of the wrapping machine.

FIG. 1 shows a wrapping machine 20, which comprises a conveyor track 30 for moving the articles 31 to be packaged to the wrapping machine 20 and the finished articles packaged by wrapping away from the packaging machine. The wrapping machine 20 also comprises a wrapping unit 40 including a revolving rotation ring 41 and a plastic wrapping film roll 42 attached to it. The wrapping machine 20 further comprises a top film handling unit 50 in which a press plate 53 revolving about an axis 52 is connected to the cantilever frame 51 for holding the article 31 being packaged in place during wrapping, and a top film carrier 54. The top films for the articles 31 being packaged come from the top film unit 60 which comprises a top film roll 61, a cutter 62 and a drawing device 63.

In FIG. 1, the wrapping unit 40 with its revolving rotation ring 41 moves in the vertical direction on the inner guides 22*a* and 22*b* of the frame 21 of the wrapping machine 20. The wrapping unit 40 is provided with lifting equipment so that articles of all sizes can be wrapped all the way up from the bottom. This lifting equipment is not shown in FIG. 1. The top film handling unit 50, on the other hand, moves in the vertical direction on the outer guides 23 of the frame 21. This unit 50 does not comprise separate lifting equipment. The top film handling unit 50 is supported on the rotation ring 41 and thus ascends and descends with the rotation ring 41. However, when the press plate 53 has been lowered on top of the article 31 being packaged, the top film handling unit 50 obviously does not descend any lower, although the rotation ring 41 and the plastic film roll 42 descend all the way to the bottom edge of the article 31 for wrapping.

In FIG. 1, the top film unit 60 moves in the outer guides 24 of the wrapping machine 20 frame 21 because it must be possible to lower the top film roll 61 in the top film unit 60 in order to replace an empty roll by a full one. The upper part of the frame 21 of the wrapping machine 20 incorporates a top film drawing device 63, which moves in a horizontal guide 25. In FIG. 1, the top film drawing device 63 is in the ready position, that is, at the home station, where it has gripped the edge of the film web 64 and pulled it slightly outwards from the roll 61. The grips of the cutter 62 are then in the open position and the film web 64 can unwind freely from the roll 61. The operation of the cutter 62 and the drawing device 63 are described below.

FIG. 1 shows a situation where the wrapping of a package 31*a* in the wrapping machine 20 has just been completed. The wrapping unit 40 is then lifted upwards, whereby the cantilever frame 51 of the top film handling unit 50 and the press plate 53 connected to it, and the top film carrier 54 in conjunction with it, rise at the same time. When the press plate 53 and the top film carrier 54 have been lifted high enough so that they have room to turn, they are turned upside down by rotating them about the axis 52. This procedure can be carried out so rapidly that the ready-packaged article 31*a* on the conveyor track has not yet had time to leave the wrapping machine 20.

Figure 2:
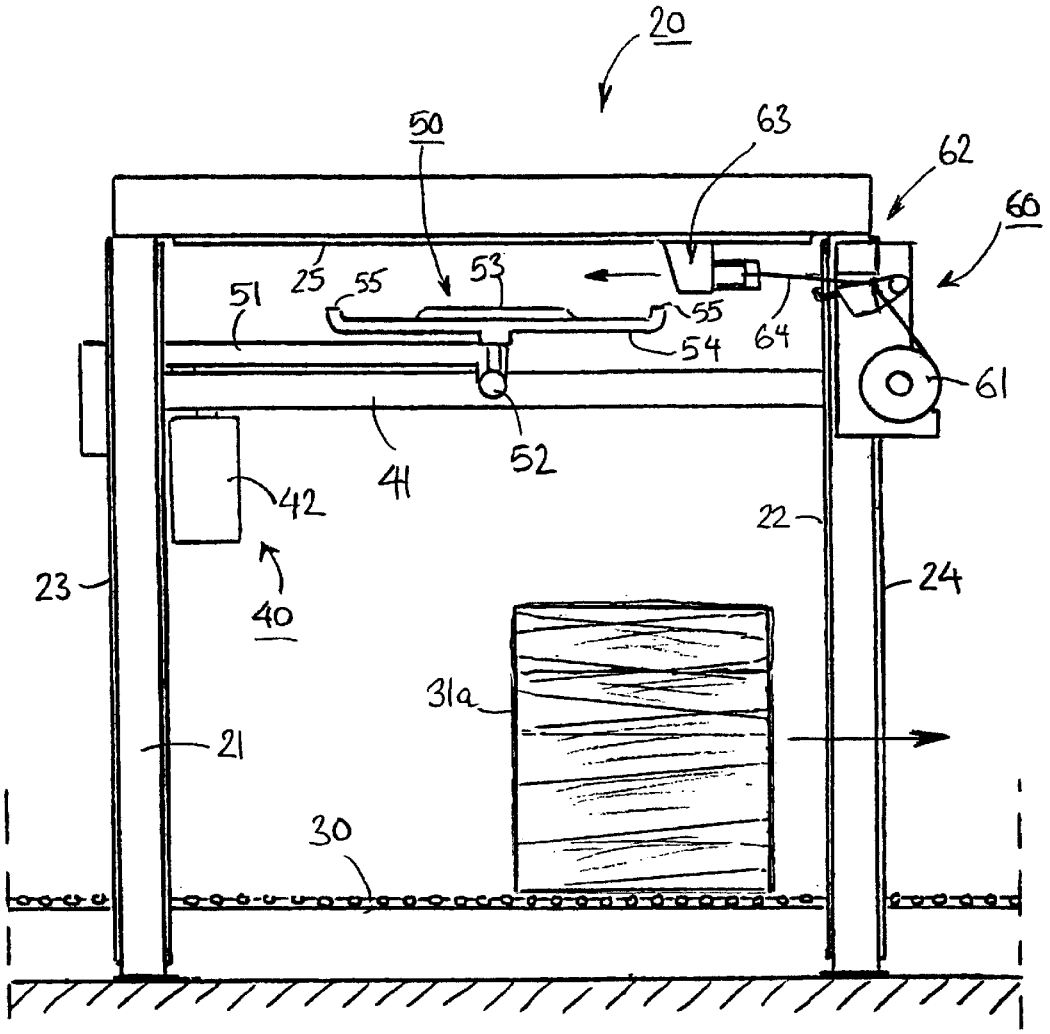

FIG. 2 shows a situation where the ready-packaged article 31*a* has started moving on the conveyor track 30 and leaves the wrapping machine 20. A new article to be packaged has not yet arrived in its place at the wrapping station. The situation where the articles to be packaged are changed over is in fact the only situation during which wrapping in the wrapping machine 20 relating to the invention is interrupted. This period of interruption due to the changing over of the articles 31 is, however, fully utilised in that a top film is brought to the device during this period, where it is ready for the next article to be packaged.

In FIG. 2, the wrapping unit 40 of the wrapping machine 20 has ascended to its upper position. The top film handling unit 50, the press plate 53 and the top film carrier 54 belonging to it are also in their upper positions and turned upside down, ready to receive a top film for the next package. The fetching of the top film starts with the drawing device 63 leaving its home station on the left in FIG. 2 and pulling the top film 64 from the roll 61 over the press plate 53 and the top film carrier 54.

Figure 3:
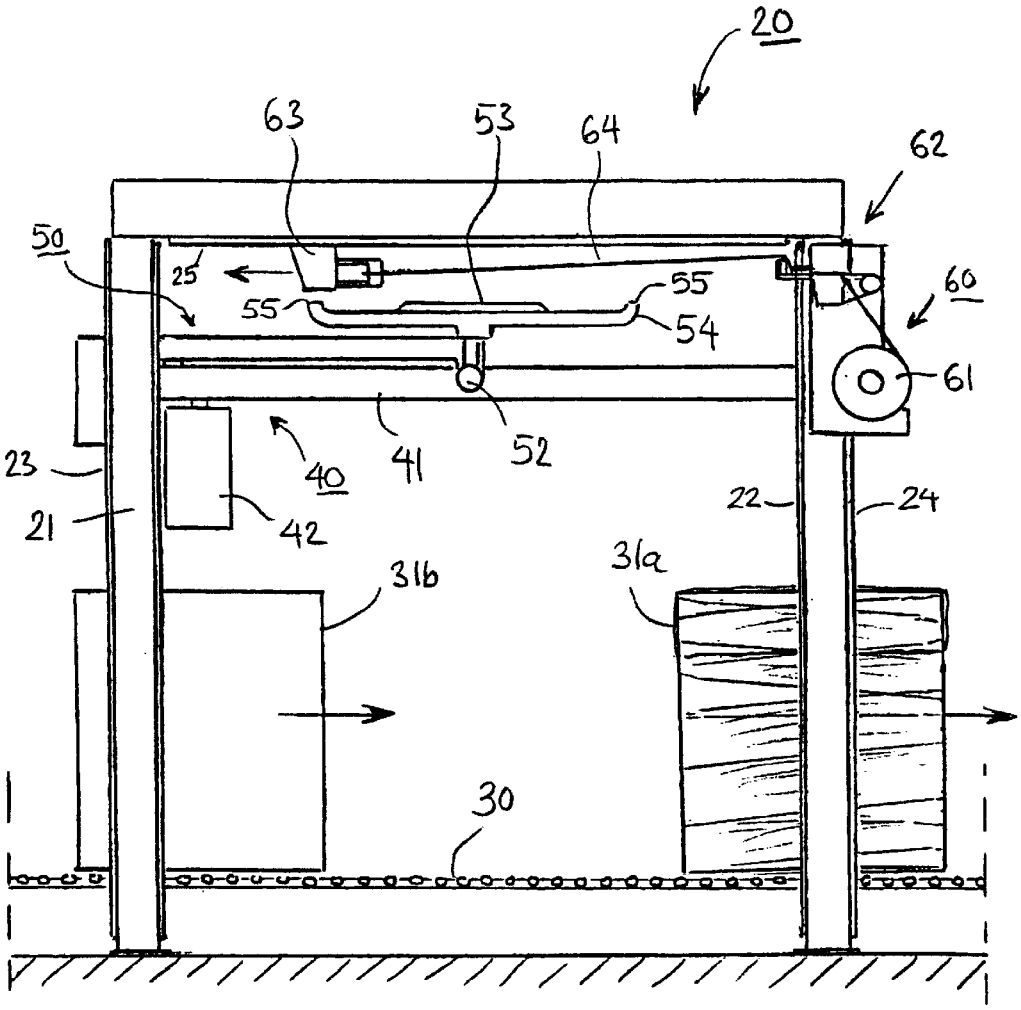

In FIG. 3, the ready-packaged article 31*a* on the conveyor track 30 has already partly left the wrapping machine 20. However, a new article 31*b* to be packaged is arriving at the machine. This period when the articles 31 are changed over is utilised for bringing the top film 64 from the roll 61 ready for the packaging of the next article 31*b*. FIG. 3 shows that the drawing device 63 has already pulled the top film 64 so far that its length will suffice to cover the article 31. During the pulling action, suction has been switched on through the nozzles 55 of the top film carrier 54, the suction pulling the top film towards the nozzles. The drawing device 63 has now stopped at the cutting station, after which the jaws of the cutter 62 close and the cutting of the top film 64 takes place.

If the wrapping machine 20 is, however, high enough so that the top film carrier 54 can easily turn, the cutting station of the drawing device 63 can at the same time be the home station of the drawing device. This means that the top film 64 is already pulled out and measured to a suitable length above the wrapping station and waiting for the next object to be packaged, which will further speed up the operation of the wrapping machine 20. When the rotation ring 41 of the wrapping unit 40 and with it the top film carrier 54 are then raised to the upper limit beneath the film 64, the cutting, centering and release of the film 64 will take place.

Since the speed of movement of the drawing device 63 is constant, the position of the drawing device 63 can be programmed in the control device of the wrapping machine 20 on the basis of the time needed for the movement. By determining the time, the position of the cutting station of the drawing device 63 can also be determined so that the top film is cut to precisely the right length for the article 31*b* to be packaged. After cutting, the top film sheet still has to be centered. This movement can also be programmed on the basis of the time needed for advancing the drawing device 63.

Figure 4:
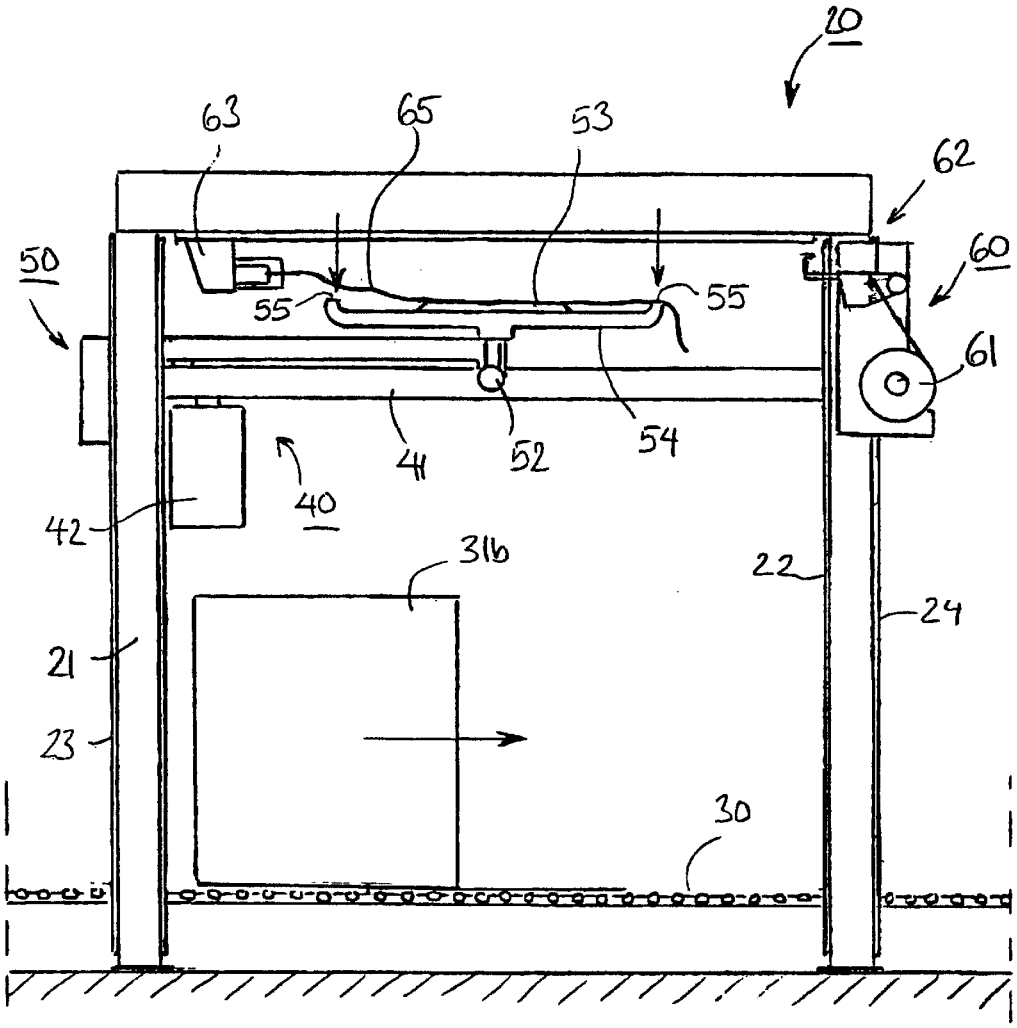

In FIG. 4, the drawing device 63 has advanced to the left side, that is, to the centering station, whereby the cut plastic film sheet 65 is centered to the middle of the press plate 53 and the top film carrier 54. The suction nozzles 55 draw the plastic film sheet 65 into contact with the nozzles. After this, the grip of the drawing device 63 releases its hold on the plastic film sheet 65.

Figure 5:
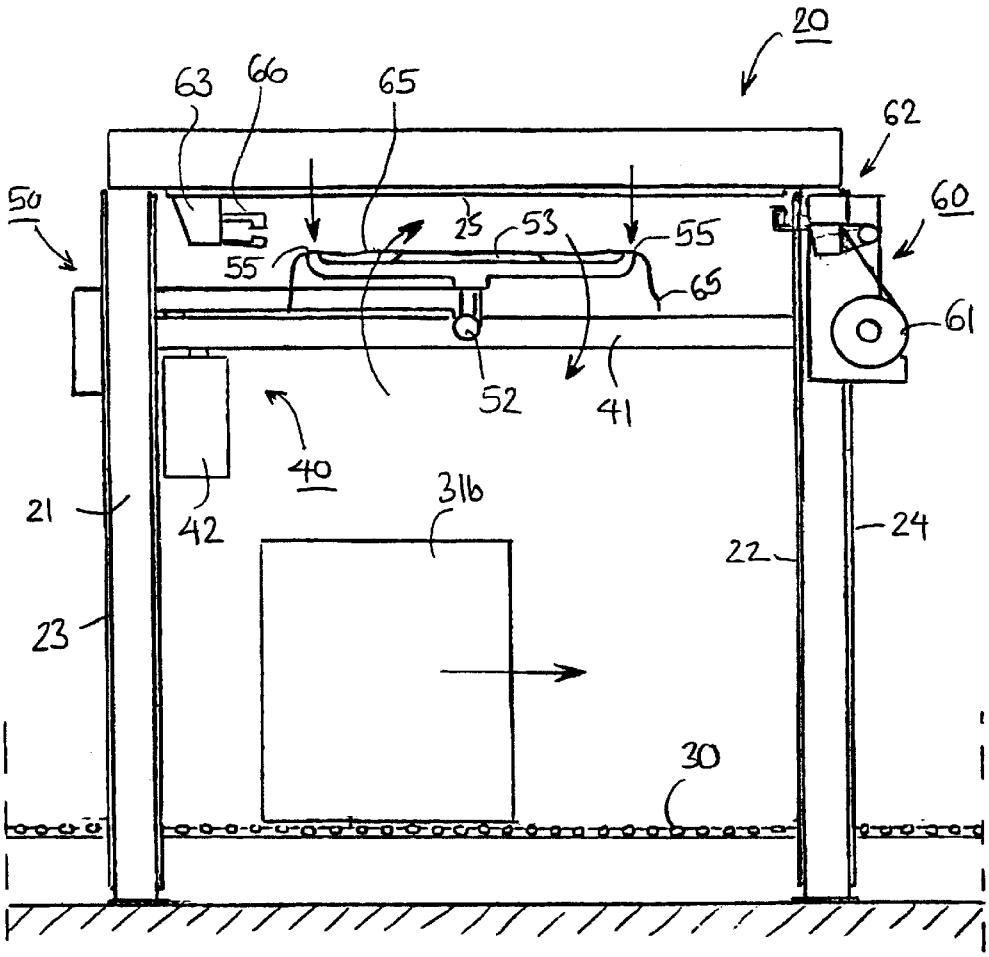

In FIG. 5, the grips 66 of the drawing device 63 are open and the plastic film sheet 65 has fallen on top of the top film carrier 54 press plate 53 as a result of being pulled by the suction nozzles 55. The Figure shows that the new article 31*b* to be packaged has already advanced quite close to the wrapping station. After this, the top film carrier 54 and the press plate 53 are again turned the right way round.

Figure 6:
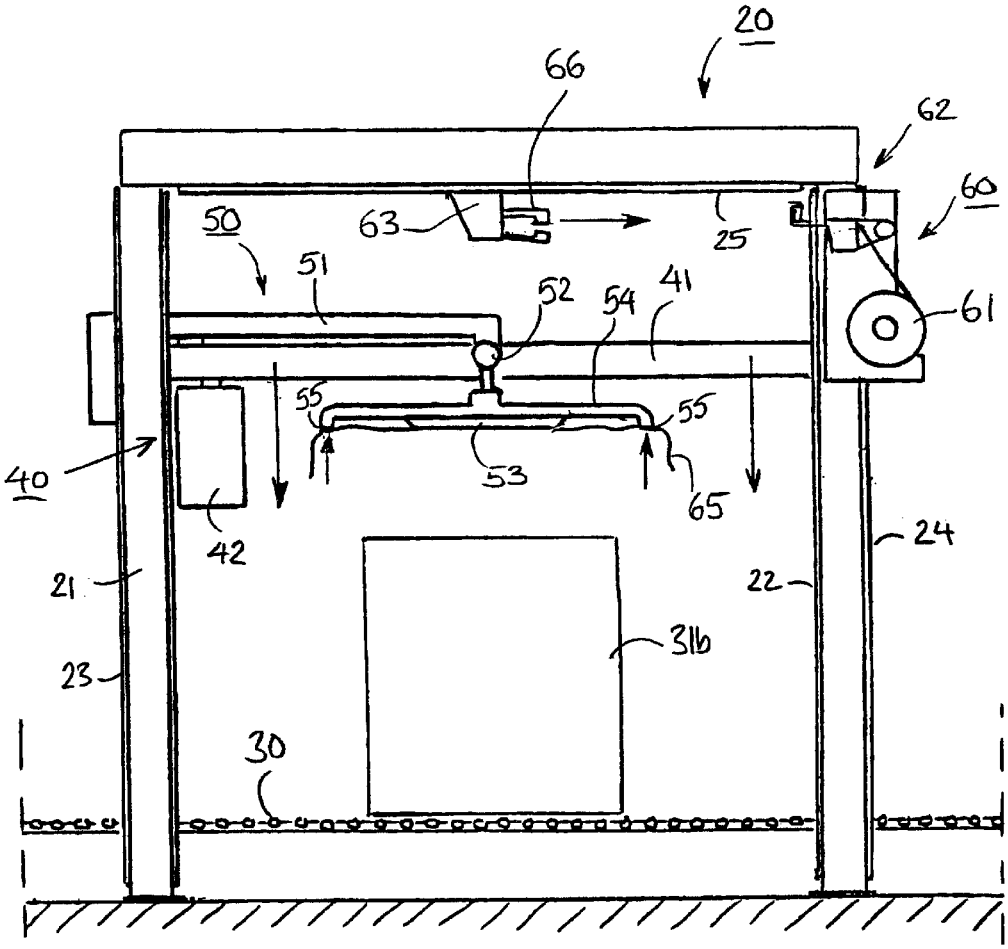

In FIG. 6, the new article 31*b* to be packaged has already advanced on the conveyor track 30 of the wrapping machine 20 to the wrapping station in the centre. When the wrapping unit 40 is lowered, the top film handling unit 50 also descends. This means that the top film carrier 54 and the press plate 53 descend on top of the article 31*b* being packaged. At the same time, the drawing device 63 moves with the grips 66 open to the right towards the top film fetching station.

Figure 7:
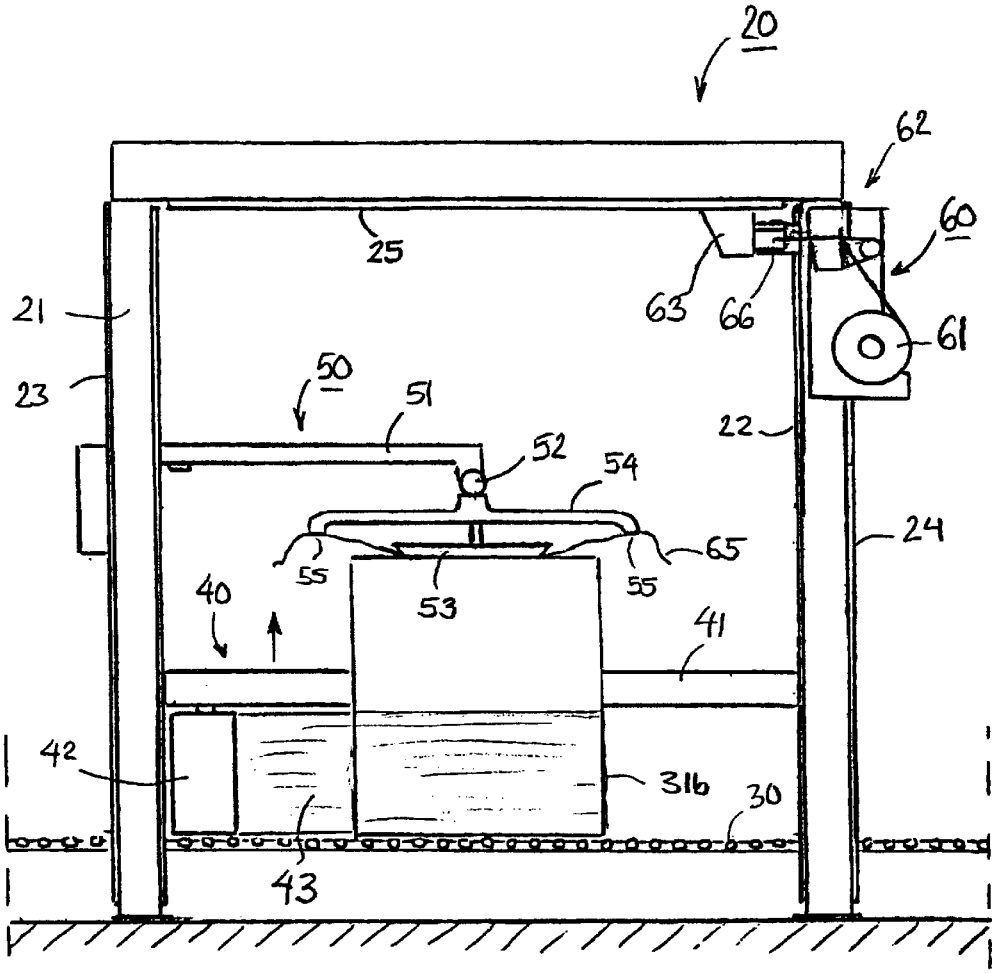

In FIG. 7, the top film carrier 54 and the press plate 53 are pressed onto the article 31*b* being packaged, whereby the top film sheet 65 remains in place between the press plate 53 and the article 31*b* being packaged. The nozzles 55 of the top film carrier 54 continue to suck and the top film sheet 65 remains attached to the top film carrier 54. By this stage, however, the top film carrier 54 has lifted off the press plate 53, upwards towards the axis 52. This means that the edges of the top film sheet 65 will rise upwards above the article 31*b* being packaged, whereby enough free space is left at the top edge of the article 31*b* to allow the article 31*b* being packaged to be wrapped completely without the edges of the top film sheet 65 being disturbed. Waterproof wrapping is started by wrapping plastic film web 43 from a roll 42 around the article 31*b*, from bottom to top.

In FIG. 7, the rotation ring 41 of the wrapping unit 40 is down and the top film drawing device 63 has reached the right edge in the Figure, that is, the fetching station. At the station, the grips 66 of the drawing device 63 grip the top film web unwinding from the roll 61, after which the drawing device 63 leaves to return to the left in the Figure, towards the ready position at the home station. If there is enough space in the wrapping machine 20 in the vertical direction, the drawing device 63 and a suitable amount of plastic film web 64 can also already be pulled above the wrapping station for the next package.

Figure 8:
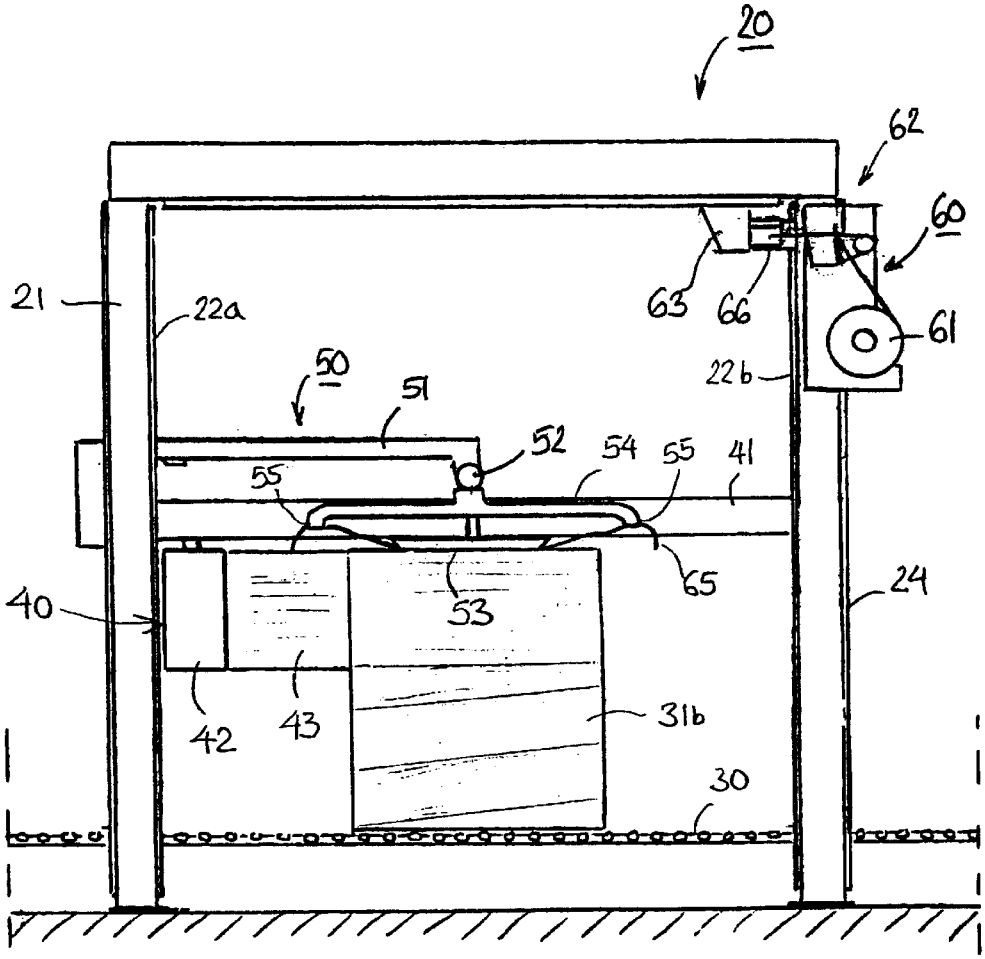

In FIG. 8, the wrapping unit 40 has advanced once over the article 31*b* being packaged, from bottom to top, whereby one layer of plastic film 43 has been wrapped from the roll 42 around the whole of the article 31*b*. This is the first stage in providing a waterproof wrapped package. When the direction of wrapping is from bottom to top, the bottom edge of the topmost plastic film web layer is always on top of the upper edge of the plastic film web layer underneath. If water enters between the plastic film layers in this type of package, it will always flow outwards, that is, the object being packaged, which is inside them, will not get wet. In the situation shown in FIG. 8, the top film carrier 54 still keeps the edges of the top film sheet 65 lifted up, which means that the article 31*b* can be wrapped right up to its top edge.

Figure 9:
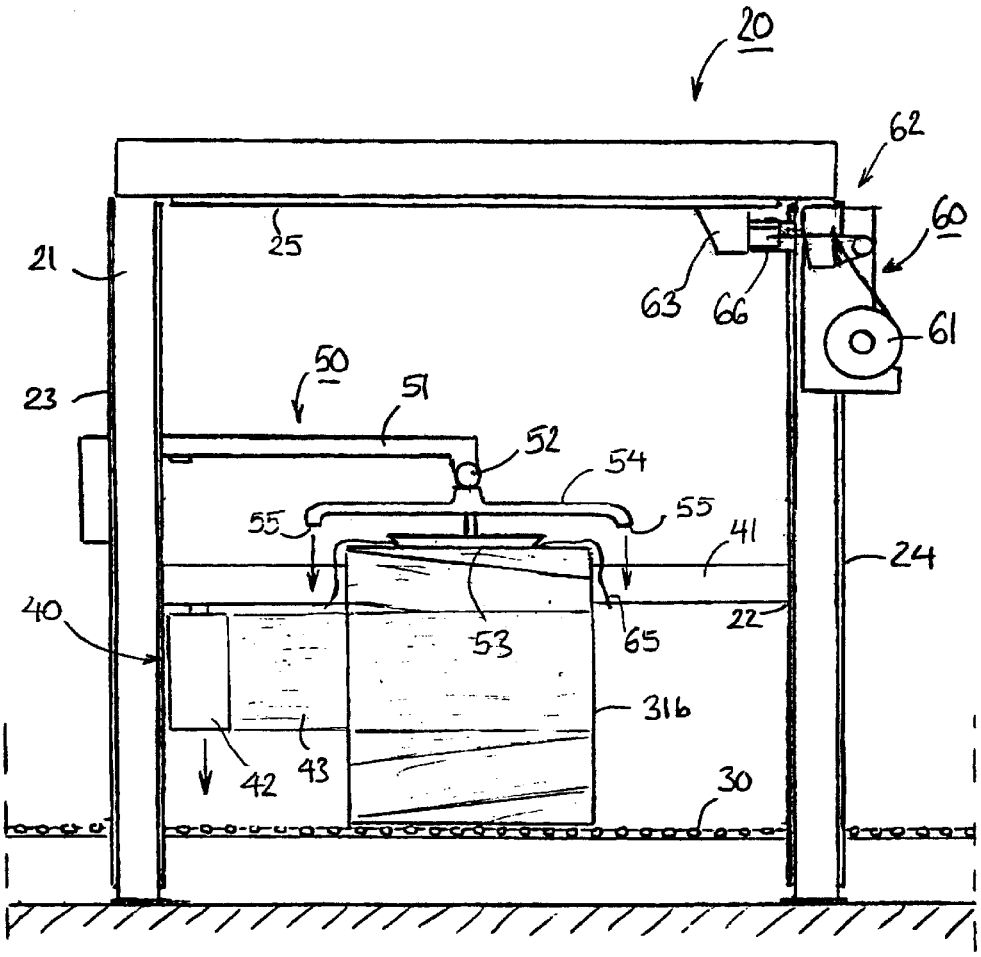

In FIG. 9, the rotation ring 41 of the wrapping unit 40 and the plastic film roll 42 which is involved in the wrapping operation throughout, have been lowered back downwards to such an extent that the edges of the top film sheet 65 can be lowered down on top of the already wrapped plastic film web layers. In the wrapping machine 20 shown in FIG. 9, the lowering of the edges of the top film sheet 65 takes place by changing the suction of the nozzles 55 of the top film carrier 54 to blowing, whereby the edges of the top film sheet 65 turn downwards and are pressed against the sides of the article 31*b* being packaged. After this the movement of the wrapping unit 40 again turns in the opposite direction, that is, upwards, and a layer of plastic film 43 is wrapped from the roll 42 onto the article 31*b*, whereby the edges of the top film sheet 65 remain under these layers of plastic film web.

Figure 10:
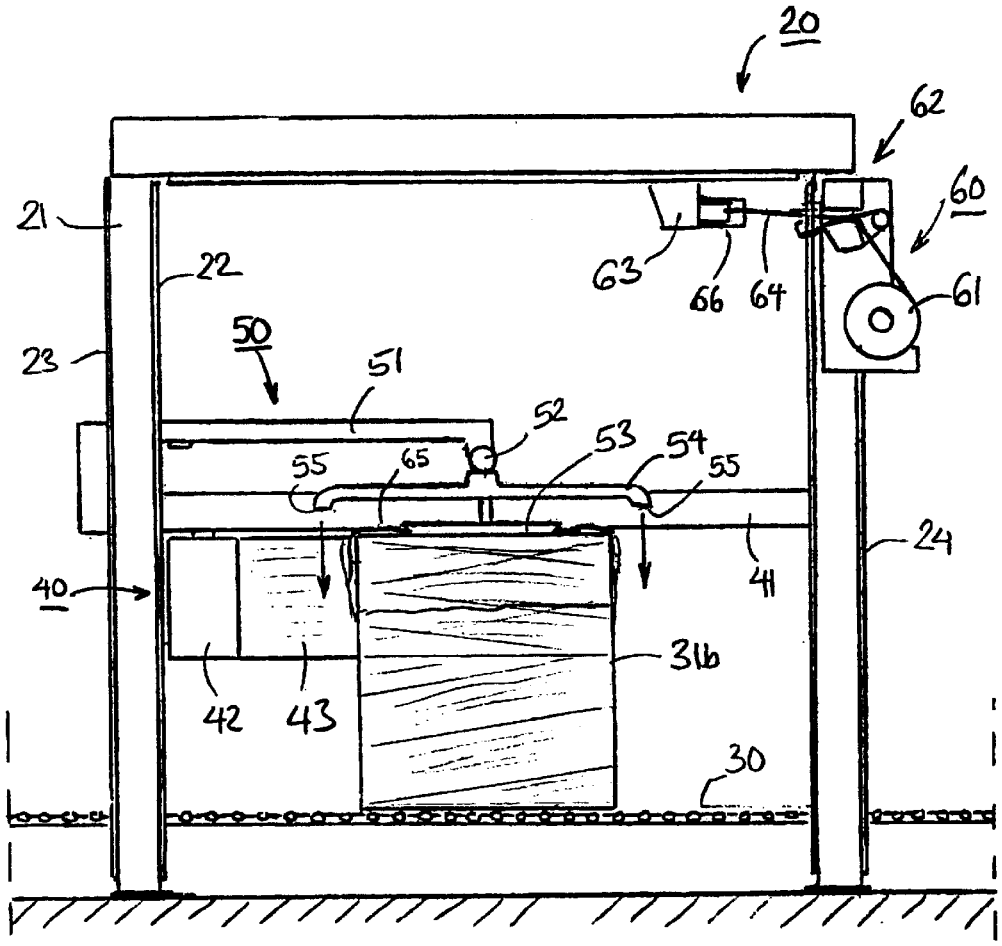

In FIG. 10, the wrapping has again advanced all the way up. The blowing from the nozzles 55 of the top film carrier 54 can be stopped as soon as the edges of the top film sheet 65 have been left under the plastic film web unwrapped from the roll 42. After this, the wrapping of the article 31*b* is stopped and seaming and cutting of the plastic film 43 are carried out in a known manner. The waterproof wrapping of the article 31*b* is now complete.

The wrapping station 40 can now be raised, whereby the press plate 53 also rises off the top of the article 31*b* and the article 31*b* can be moved away from the wrapping machine on the conveyor track 30. After this the cycle of packaging procedures starts from the beginning again, from the situation shown previously in FIG. 1.

It is obvious to a person skilled in the art that the different embodiments of the invention may vary within the scope of the claims presented below.

What is claimed is:

1. A method of packaging by wrapping, according to which method a top film is placed on top of the object (31) being packaged and plastic film web (43) used as packaging material is wrapped around the object being packaged, and which method involves the following stages:

- a top film sheet (65) of the desired size is cut from a top film web (64), which sheet is brought to a wrapping station,
- the top film sheet (65) is pressed onto the object (31) being packaged,
- during a first wrapping stage, the edges of the top film sheet (65) are kept lifted up and plastic film web (43) is wrapped around the object (31) being packaged,
- the edges of the top film sheet (65) are turned downwards on top of the already wrapped plastic film layer,
- and during a second wrapping stage, plastic film web (43) is wrapped on top of the edges of the top film sheet, characterised in

- that during the changeover of the objects (31) being packaged, the top film sheet (65), which is cut from the top film web (64) is brought to a top film carrier (54) over a pressing device (53),
- that the top film carrier (54), the pressing device (53) and the top film sheet (65) are turned upside down so that the the top film sheet is carried under the pressing device,
- and that when the next object (31) being packaged is brought to the wrapping station, the pressing device (53) is pressed onto the object being packaged so that the upside down turned top film sheet (65) remains in place between the pressing device and the object being packaged.

2. A method of packaging by wrapping as claimed in claim 1, characterised in that the top film sheet (65) is pressed onto the object (31) being packaged by means of a pressing device (53) while at the same time lifting the edges of the top film sheet upwards by means of the suction nozzles (55) of the top film sheet carrier (54).

3. A method of packaging by wrapping as claimed in claim 2, characterised in that the top film sheet (65) is gripped by means of suction nozzles (55) and the edges of the top film sheet are pressed downwards by means of blow nozzles.

4. A method of packaging by wrapping as claimed in claim 2, characterised in that the same nozzle (55) is used as a suction nozzle and a blow nozzle, the function of which nozzle is selected by connecting the nozzle duct either to the suction side of the fan or the pressure side of the fan.

5. A wrapping machine (20) for packaging an object (31) to be packaged with a top film sheet (65) and a plastic film web (43) used for wrapping, the wrapping machine comprising:

a device (60) for cutting the top film sheet (65) of a desired size from a top film web (64), a device (50) for bringing the top film sheet (65) to the wrapping station, a top film carrier (54) and means (55) for keeping the top film sheet (65) attached to the top film carrier, a pressing device (53) for pressing the top film sheet (65) onto the object (31) being packaged, a gripping means (55) for keeping the edges of the top film sheet (65) lifted up and/or turning the edges downwards onto the sides of the object (31) being packaged, and a wrapping device (40) for wrapping the plastic film web (43) around the object (31) being packaged, characterised in that the wrapping machine comprises means (63) for bringing the top film sheet (65), which is cut from the top film web (64), to the wrapping station over the top film carrier (54) and the pressing device (53), means (52) for turning upside down the top film carrier (54), the pressing device (53) and the top film sheet (65), and means (51) for pressing the upside down turned top film sheet (65) onto the object (31) being packaged by means of the pressing device (53).

6. A wrapping machine (20) as claimed in claim 5, characterised in that the gripping means (55) of the top film sheet (65) carrier (54) are suction nozzles and the pushing means are blow nozzles.

7. A wrapping machine (20) as claimed in claim 6, characterised in that the nozzles (55) of the top film sheet (65) carrier (54) are double acting, so that the same nozzles serve as both suction nozzles and blow nozzles, that the nozzles (55) are connected to the fan by means of a change-over valve in such a way that the nozzles are suction nozzles when the change-over valve connects the nozzles to the suction side of the fan, and that the nozzles (55) are blow nozzles when the change-over valve connects the nozzles to the pressure side of the fan.

8. A wrapping machine (20) as claimed in claim 5, characterised in that a pressing device (53) is attached to the top film carrier (54) of the wrapping machine (20) for pressing the top film sheet (65) onto the article (31) being packaged.

9. A wrapping machine (20) as claimed in claim 8, characterised in that the top film carrier (54) and pressing device (53) of the wrapping machine (20) are located above the rotation ring (41) in such a way that the combined top film carrier and pressing device can be lifted by means of the rotation ring.

* * * * *